US010386764B2

(12) United States Patent
Kajita et al.

(10) Patent No.: US 10,386,764 B2
(45) Date of Patent: Aug. 20, 2019

(54) FIXING DEVICE HAVING A MULTI-POSTION CAM ASSEMBLY

(71) Applicant: Brother Kogyo Kabushiki Kaisha, Nagoya-shi, Aichi-ken (JP)

(72) Inventors: Masahito Kajita, Nagoya (JP); Kenji Takeuchi, Nagoya (JP); Hisashi Tsukawaki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/911,261

(22) Filed: Mar. 5, 2018

(65) Prior Publication Data

US 2018/0267448 A1 Sep. 20, 2018

(30) Foreign Application Priority Data

Mar. 15, 2017 (JP) ..... 2017-050014

(51) Int. Cl.
*G03G 15/20* (2006.01)

(52) U.S. Cl.
CPC ..... *G03G 15/206* (2013.01); *G03G 15/2032* (2013.01); *G03G 2215/2074* (2013.01)

(58) Field of Classification Search
CPC ..... G03G 15/2067; G03G 15/2071; G03G 15/2089; G03G 15/2032
See application file for complete search history.

(56) References Cited

U.S. PATENT DOCUMENTS 5,956,553 A * 9/1999 Park ..... G03G 15/1605 399/307
6,058,286 A * 5/2000 Park ..... G03G 15/1605 399/121
6,343,203 B1 * 1/2002 Pang ..... G03G 15/1605 399/307

(Continued)

FOREIGN PATENT DOCUMENTS

JP S60-6165 U 1/1985
JP H5-249856 A 9/1993
JP 2002-341683 A 11/2002

(Continued)

OTHER PUBLICATIONS

JP2011133502A_English machine-translation of description (Year: 2011).*

*Primary Examiner* — Walter L Lindsay, Jr.
*Assistant Examiner* — Arlene Heredia
(74) *Attorney, Agent, or Firm* — Banner & Witcoff, Ltd.

(57) ABSTRACT

To switch between four nip modes, a cam is driven by a single drive to move between first to fourth positions. At the first position, a first nip between a first pressing body and a fixing member has a first width, and a second nip between a second pressing body and the fixing member has a second width. At the second position, the first nip has a third width smaller than the first width, and the second nip has a width greater than or equal to the second width. At the third position, the first nip has a width greater than or equal to the first width, and the second nip has a fourth width smaller than the second width. At the fourth position, the first nip has a fifth width smaller than the first width, and the second nip has a sixth width smaller than the second width.

13 Claims, 10 Drawing Sheets

(56) References Cited

U.S. PATENT DOCUMENTS

| | | | | |
|---|---|---|---|---|
| 8,891,990 | B2 * | 11/2014 | Yuasa | G03G 15/2032 399/67 |
| 2014/0153938 | A1 | 6/2014 | Saito | |

FOREIGN PATENT DOCUMENTS

| | | | |
|---|---|---|---|
| JP | 2011-133502 | A | 7/2011 |
| JP | 2014-106320 | A | 6/2014 |

* cited by examiner

SECOND POSITION

THIRD POSITION

FOURTH POSITION

1ST POSITION
182(180)
TOP
REAR
FRONT
BOTTOM
150
A3
181(180)
150
153
182A
182(180)
181A
181B
182B
160
163
160
A3

2ND POSITION
150
181A
150
153
182B
A3
181(180)
A3
182(180)
182A
160
163
181B
160

3RD POSITION
150
A3
181(180)
150
153
181B
181A
182(180)
182B
A3
163
160
160
182A

4TH POSITION
150
181B
150
153
A3
181(180)
182A
A3
182(180)
160
181A
163
160
182B

SECOND POSITION

FOURTH POSITION

THIRD POSITION

SECOND POSITION

FOURTH POSITION

THIRD POSITION

FIXING DEVICE HAVING A MULTI-POSTION CAM ASSEMBLY

CROSS-REFERENCE TO RELATED APPLICATION

This application claims priority from Japanese Patent Application No. 2017-50014 filed on Mar. 15, 2017, the content of which is incorporated herein by reference in its entirety.

TECHNICAL FIELD

Aspects of the disclosure relate to a fixing device that thermally fixes a toner image onto a sheet.

BACKGROUND

A variety of externally heating fixing devices have been developed for directly heating the outer periphery of a roller or film facing a heater. One example is a fixing device described in Japanese Patent Application Publication No. 2011-133502, which heats a fixing roller at its heat nip between the fixing roller and a heater, and fixes a toner image onto a sheet at its press nip between the fixing roller and a pressing roller.

This fixing device includes a pivotable heater arm that supports a heater, a pivotable pressing roller arm that supports a pressing roller, and a spring that connects the arms. The arms are pulled toward each other by the spring to press the heater and the pressing roller against the fixing roller, thus forming the heat nip and the press nip. The device further includes a cam between the heater arm and the pressing roller arm. The cam rotates while pressing the heater arm and the pressing roller arm away from each other to release the nip pressure both at the heat nip and at the press nip.

SUMMARY

Although one of the two nips may desirably have a smaller nip pressure, the structure described in Japanese Patent Application Publication No. 2011-133502 allows switching between the two nip modes: one in which the nips both have a predetermined nip pressure, and the other in which the nips both have a nip pressure smaller than the predetermined nip pressure. To allow switching between four nip modes, or the mode in which only the heat nip has a smaller nip pressure and the mode in which only the press nip has a smaller nip pressure in addition to the mode in which the two nips both have a predetermined nip pressure and the mode in which the two nips both have a smaller nip pressure, the device uses two cams and two drives for the cams. This increases the number of components.

One or more aspects of the disclosure are directed to a fixing device including two nips and having a simple structure that allows switching between four nip modes.

According to an aspect of the disclosure, a fixing device includes a first pressing body, a second pressing body, a fixing member located between the first pressing body and the second pressing body, a heater configured to heat the fixing member, a first arm, a second arm, elastic member, and a cam assembly. The first arm is pivotable about a first shaft, and includes a first pressing portion configured to press the first pressing body against the fixing member. The second arm is pivotable about a second shaft parallel to the first shaft, and includes a second pressing portion configured to press the second pressing body against the fixing member. The elastic member is configured to urge the first pressing portion and the second pressing portion toward each other. The cam assembly is located between the first arm and the second arm and rotatable about a third shaft parallel to the first shaft. The cam assembly includes a first cam configured to rotate about the third shaft and press the first arm against an urging force of the elastic member, and a second cam located at a position different from the first cam in an axial direction of the third shaft. The second cam is configured to rotate about the third shaft integrally with the first cam and press the second arm against the urging force of the elastic member. The cam assembly is movable between a first position, a second position, a third position, and a fourth position when driven by a single drive. When the cam assembly is at the first position, a first nip between the first pressing body and the fixing member has a first width, and a second nip between the second pressing body and the fixing member has a second width. When the cam assembly is at the second position, the first nip has a third width smaller than the first width, and the second nip has a width greater than or equal to the second width. When the cam assembly is at the third position, the first nip has a width greater than or equal to the first width, and the second nip has a fourth width smaller than the second width. When the cam assembly is at the fourth position, the first nip has a fifth width smaller than the first width, and the second nip has a sixth width smaller than the second width.

The above structure allows switching between four nip modes by changing the position of the cam between four positions using a single drive.

According to another aspect of the disclosure, a fixing device includes a first pressing body, a second pressing body, a fixing member located between the first pressing body and the second pressing body, a heater configured to heat the fixing member, a first arm, a second arm, an elastic member, and a cam. The first arm is pivotable about a first shaft, and includes a first pressing portion configured to press the first pressing body against the fixing member. The second arm is pivotable about a second shaft parallel to the first shaft, and includes a second pressing portion configured to press the second pressing body against the fixing member. The elastic member is configured to urge the first pressing portion and the second pressing portion toward each other. The cam is located between the first arm and the second arm. The cam is configured to rotate and press at least one of the first arm and the second arm against an urging force of the elastic member. The cam is movable between a first position, a second position, a third position, and a fourth position when driven by a single drive. When the cam is at the first position, a first nip between the first pressing body and the fixing member has a first width, and a second nip between the second pressing body and the fixing member has a second width. When the cam is at the second position, the first nip has a third width smaller than the first width, and the second nip has a width greater than or equal to the second width. When the cam is at the third position, the first nip has a width greater than or equal to the first width, and the second nip has a fourth width smaller than the second width. When the cam is at the fourth position, the first nip has a fifth width smaller than the first width, and the second nip has a sixth width smaller than the second width.

The above structure allows switching between four nip modes by changing the position of the cam between four positions simply using a single drive.

The simple structure according to one or more embodiments of the disclosure allows switching between the four nip modes.

DETAILED DESCRIPTION

First Embodiment

A first embodiment of the disclosure will now be described in detail with reference to drawings. The overall structure of a color printer 1 will be described, and then its main components will be described in detail.

Figure 1:
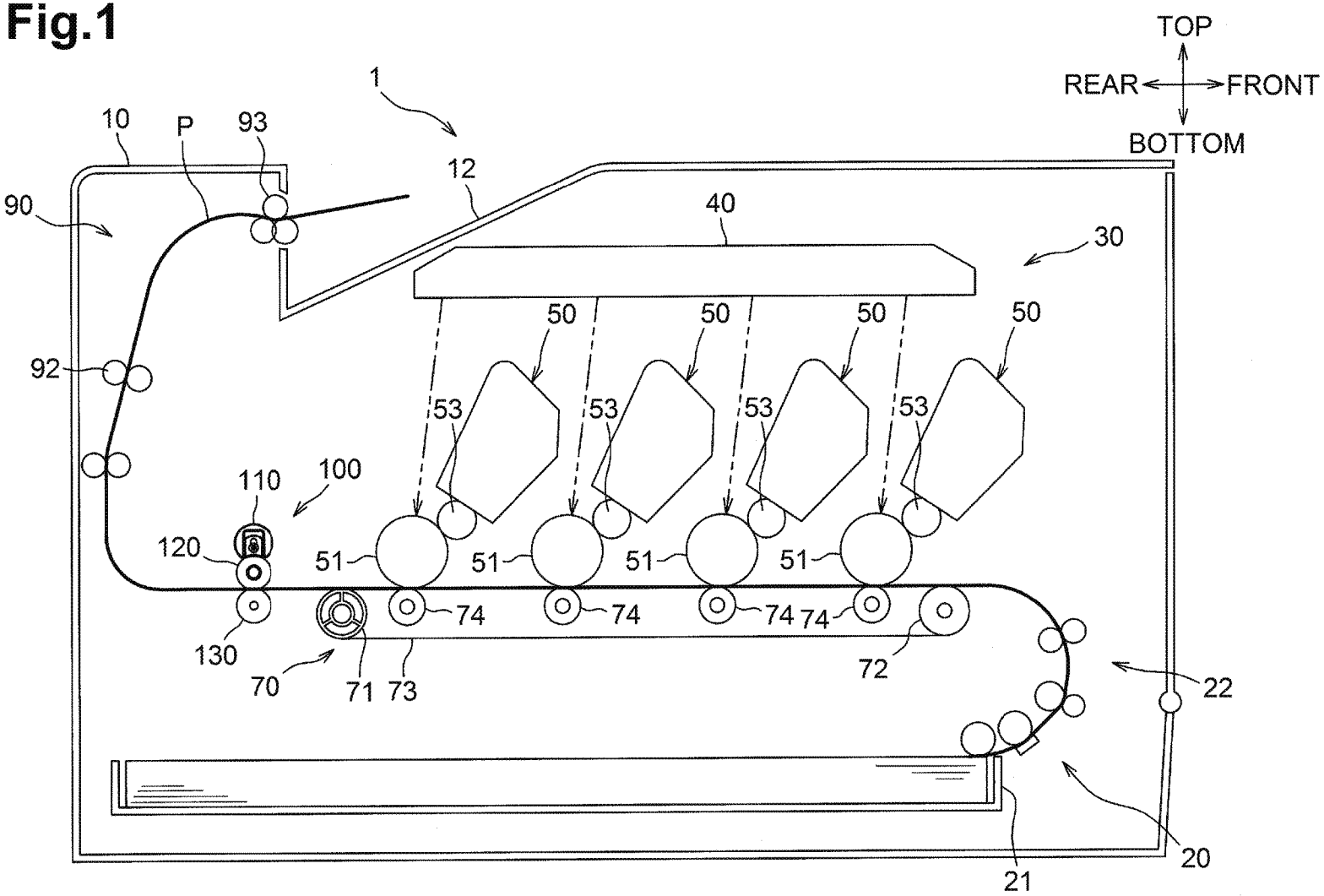
FIG. 1 is a simplified cross-sectional view of a color printer including a fixing device according to a first embodiment of the disclosure.

The directions used herein are the directions shown in FIG. 1, in which the right side is the front, the left side is the rear, the facing side is the left, the opposite side is the right, the upper side is the top, and the lower side is the bottom.

As shown in FIG. 1, the color printer 1 includes a body casing 10 containing a sheet feeder 20, an image forming unit 30, and a discharge unit 90. The sheet feeder 20 feeds a sheet of paper P, which is an example of a recording sheet. The image forming unit 30 forms an image on the fed sheet P.

The sheet feeder 20 includes a feed tray 21, which contains sheets P, and a sheet transporting mechanism 22, which transports the sheets P in the feed tray 21 to the image forming unit 30.

The image forming unit 30 includes a scanner unit 40, a plurality of, four, process cartridges 50, a transfer unit 70, and a fixing device 100.

The scanner unit 40 is arranged in an upper part of the space inside the body casing 10. The scanner unit 40 includes a laser beam emitter, a polygon mirror, a lens, and a reflector. The scanner unit 40 applies a laser beam to the surfaces of photosensitive drums 51 by high speed scanning.

The process cartridges 50, which are located above the sheet feeder 20, are aligned in the front-rear direction in the figure. Each process cartridge 50 includes a photosensitive drum 51, a developing roller 53, and other components (not shown) including a charging device and a toner chamber.

The transfer unit 70 is located between the sheet feeder 20 and the four process cartridges 50, and includes a driving roller 71, a driven roller 72, a transport belt 73, and transfer rollers 74.

The driving roller 71 and the driven roller 72 are arranged parallel to and spaced from each other in the front-rear direction, with an endless transport belt 73 stretching between them. The four transfer rollers 74 facing the corresponding photosensitive drums 51 are arranged inside the transport belt 73 to hold the transport belt 73 together with the photosensitive drums 51.

The fixing device 100 is located rearward from the four process cartridges 50 and the transfer unit 70. The fixing device 100 includes a heating unit 110, which is an example of a first pressing body and a heating member, a fixing roller 120, which is an example of a fixing member, and a pressing roller 130, which is an example of a second pressing body and a pressing member.

The image forming unit 30 includes charging devices (not shown) that uniformly charge the surfaces of the rotating photosensitive drums 51. The scanner unit 40 emits a laser beam onto the surfaces of the photosensitive drums 51 to expose the surfaces and thus form electrostatic latent images corresponding to image data onto the surfaces of the photosensitive drums 51.

Each rotating developing roller 53 feeds toner, which is an example of a developer, to the electrostatic latent image on the corresponding photosensitive drum 51 to form a developer image on the surface of the photosensitive drum 51. While a sheet P fed from the sheet feeder 20 is being transported between the photosensitive drums 51 and the transfer rollers 74, the developer image on the photosensitive drum 51 is transferred onto the sheet P. The fixing device 100 then thermally fixes the developer image on the sheet P.

The discharge unit 90 includes second transport rollers 92 and discharge rollers 93, which discharge the sheets P out of the body casing 10 onto a discharge tray 12.

Figure 2:
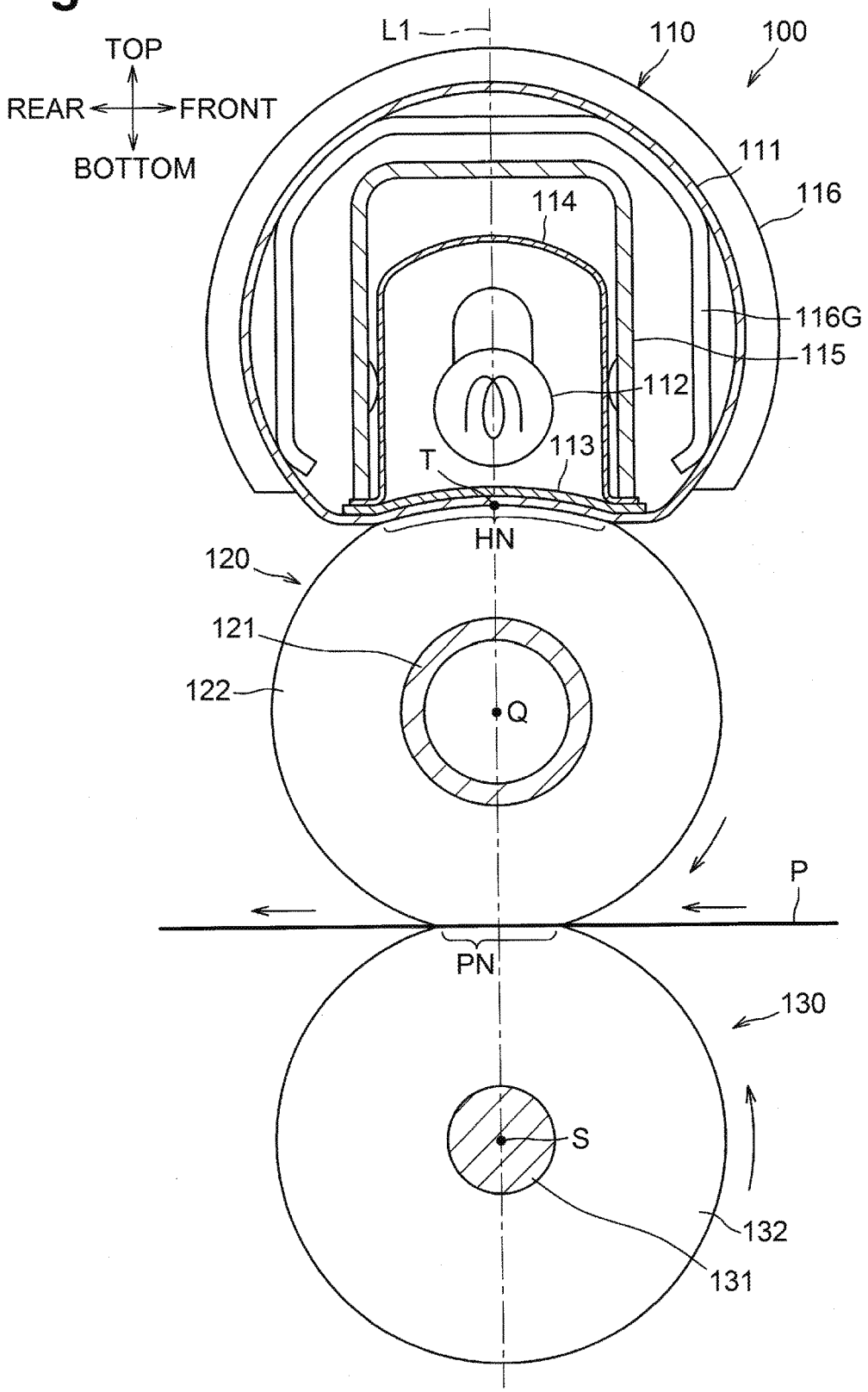
FIG. 2 is a cross-sectional view of the fixing device.

As shown in FIG. 2, the heating unit 110 is in contact with the fixing roller 120 to heat the fixing roller 120. The heating unit 110 and the pressing roller 130 are on opposite sides of the fixing roller 120. The heating unit 110 includes an endless belt 111, a halogen lamp 112, which is an example of a heater, a nip plate 113, a reflection plate 114, a stay 115, and side guides 116.

The endless belt 111 is a heat-resistant and flexible belt with no ends. The endless belt 111 is held between the nip plate 113 and the fixing roller 120 while rotating. The endless belt 111 comes in contact with the fixing roller 120 to form a heat nip HN.

The halogen lamp 112 is a heater for heating the nip plate 113 and the endless belt 111, and is at a predetermined distance from the nip plate 113.

The nip plate 113, which is laterally elongated, has a surface that is in slidable contact with the inner circumferential surface of the cylindrical endless belt 111. The nip plate 113 transfers radiant heat from the halogen lamp 112 to the fixing roller 120 through the endless belt 111. In other words, the halogen lamp 112 heats the fixing roller 120 through the nip plate 113 and the endless belt 111. The nip plate 113 is, for example, a metal plate such as an aluminum plate.

The reflection plate 114 reflects radiant heat from the halogen lamp 112 toward the nip plate 113. The reflection plate 114 is at a predetermined distance from the halogen lamp 112 and surrounds the halogen lamp 112. The reflection plate 114 allows radiant heat from the halogen lamp 112 to be concentrated on the nip plate 113, and thus can immediately heat the nip plate 113 and the endless belt 111.

The stay 115 supports the front and rear ends of the nip plate 113 with the reflection plate 114 between the stay 115 and the nip plate 113 to increase the rigidity of the nip plate 113. The stay 115 has a substantially U-shaped cross-section, surrounding the halogen lamp 112 and the reflection plate 114.

The side guides 116 each include a guide portion 116G, which guides the inner circumferential surface of the endless belt 111. The side guides 116 restrict lateral movement of the endless belt 111. The endless belt 111 has one side guide 116 arranged at each of its two sides. The side guides 116 support the halogen lamp 112, the nip plate 113, the reflection plate 114, and the stay 115.

The fixing roller 120 is located under the heating unit 110 and between the heating unit 110 and the pressing roller 130. The fixing roller 120 includes a roller shaft 121, which is formed from a hollow metal tube, and a roller body 122, which is formed from a rubber layer on the outer circumference of the roller shaft 121. The fixing roller 120 rotates clockwise in the figure under a driving force applied from a drive (not shown).

The pressing roller 130 is located under the fixing roller 120, and transports a sheet P while holding the sheet P between the pressing roller 130 and the fixing roller 120. The pressing roller 130 includes a pressing roller shaft 131, which is formed from a solid metal rod, and a pressing roller body 132, which is formed from a rubber layer. The pressing roller body 132 is arranged on the outer circumference of the pressing roller shaft 131 to come into contact with the sheets P. The pressing roller shaft 131 has a smaller diameter than the roller shaft 121 of the fixing roller 120. The rubber layer used for the pressing roller body 132 is softer and is thicker than the rubber layer used for the roller body 122 of the fixing roller 120. The pressing roller 130 comes in contact with the fixing roller 120 to form a press nip PN.

The heating unit 110, the fixing roller 120, and the pressing roller 130 are aligned linearly. More specifically, the heat nip HN has a center T on a straight line L1 passing through a rotation center Q of the fixing roller 120 and through a rotation center S of the pressing roller 130. The center T of the heat nip HN serves as the center of the fixing roller 120 in the rotation direction.

Figure 3:
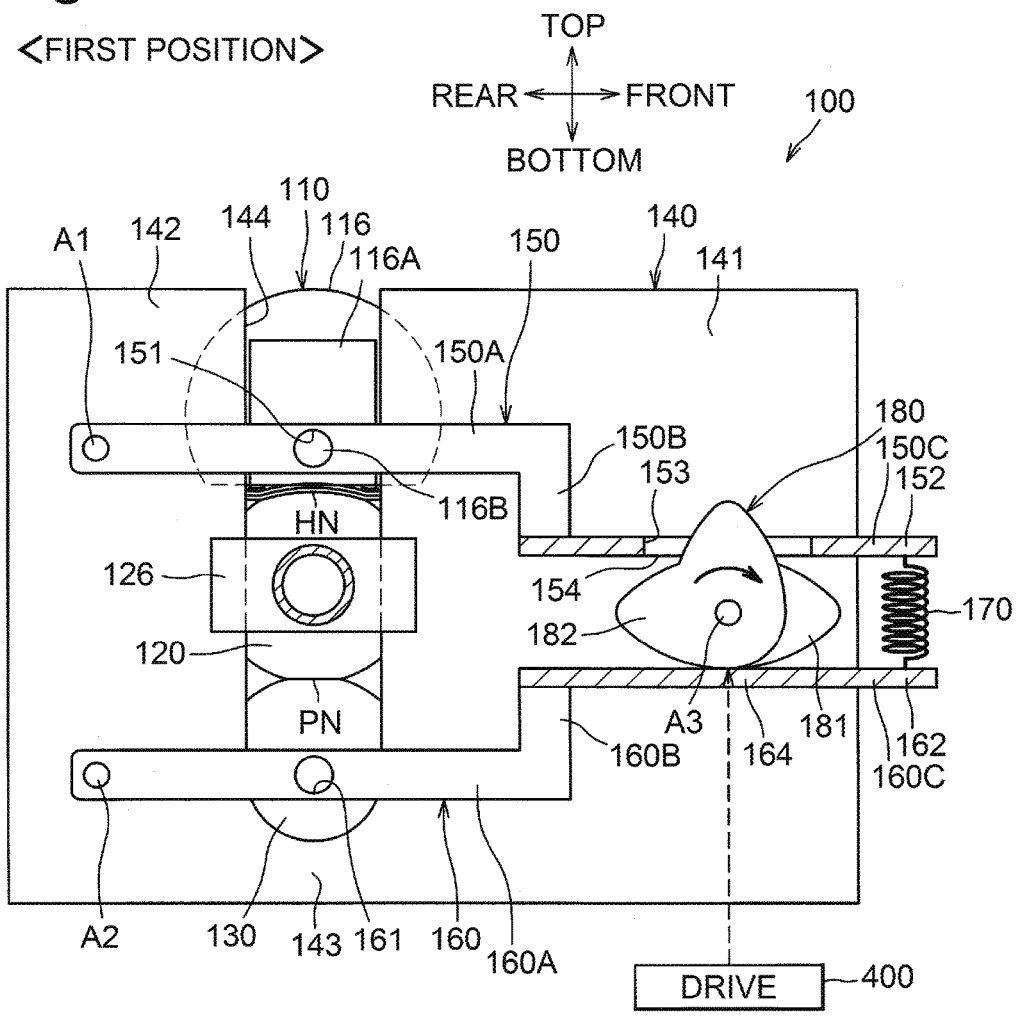
FIG. 3 is a side view of the fixing device showing its components viewed from the left, including a first arm and a second arm, and a separating cam at a first position.

As shown in FIG. 3, the fixing device 100 further includes, on each side, a side frame 140, a first arm 150, a second arm 160, a tension spring 170, which is an example of an elastic member, and a separating cam assembly 180.

The side frame 140 is arranged on each of the right and left sides of the heating unit 110, the fixing roller 120, and the pressing roller 130. Each side frame 140 is a flat frame including a front wall 141, a rear wall 142, and a connector 143 connecting the lower end portions of the front wall 141 and the rear wall 142 together. The front wall 141 is at a predetermined distance from the rear wall 142. A guide groove 144 is formed between the front wall 141 and the rear wall 142. The guide groove 144 extends linearly in the vertical direction.

The fixing roller 120 has its both ends protruding outside the side frames 140 through the guide grooves 144, and rotatably supported by plates 126. Each plate 126 extends across the front wall 141 and the rear wall 142 and is fixed to the front wall 141 and the rear wall 142.

The side guides 116 each include a guided portion 116A, which is vertically movably supported by the corresponding guide groove 144, and a connection shaft 116B, which is rotatably connected to the corresponding first arm 150.

The first arm 150 extends in the front-rear direction. The first arm 150 has its rear end portion supported by the rear wall 142 of the corresponding side frame 140 with a first shaft A1, and is thus pivotable about the first shaft A1. The first arm 150 includes a first beam portion 150A, a second beam portion 150B, and a third beam portion 150C.

The first beam portion 150A extends in the front-rear direction from the first shaft A1 to a position frontward from the heating unit 110. The first beam portion 150A includes a first pressing portion 151, which presses the heating unit 110 against the fixing roller 120.

In the present embodiment, the first pressing portion 151 is an upper half of an inner circumferential surface of a hole that rotatably supports the connection shaft 116B. The first pressing portion 151 may not have the shape described in the present embodiment, and may have any shape that allows its contact with the heating unit 110 for pressing the heating unit 110 against the fixing roller 120. For example, the first pressing portion 151 may be a protrusion.

The second beam portion 150B vertically extends from the front end of the first beam portion 150A toward the second arm 160.

The third beam portion 150C extends in the front-rear direction from the lower end of the second beam portion 150B away from the first shaft A1. The third beam portion 150C includes a first pressed portion 154, which is pressed by a first cam 181 described later. The third beam portion 150C has its end away from the second beam portion 150B to serve as a first connector 152, to which a first end of the corresponding tension spring 170 is connected.

The first connector 152 is located opposite to the first shaft A1 with the first pressing portion 151 between them. The first connector 152 may have any shape that allows its contact with the tension spring 170 for pressing the heating unit 110 against the fixing roller 120. The first connector 152 may be, for example, a hole or a protrusion.

The pressing roller 130 has its both ends protruding outside the side frames 140 through the guide grooves 144, and rotatably supported by the second arms 160.

Each second arm 160 extends in the front-rear direction. The second arm 160 has its rear end portion supported by the rear wall 142 of the corresponding side frame 140 with a second shaft A2 parallel to the first shaft A1, and is thus pivotable about the second shaft A2. The second arm 160 includes a fourth beam portion 160A, a fifth beam portion 160B, and a sixth beam portion 160C.

The fourth beam portion 160A extends in the front-rear direction from the second shaft A2 to a position frontward from the pressing roller 130. The fourth beam portion 160A includes a second pressing portion 161, which presses the pressing roller 130 against the fixing roller 120.

In the present embodiment, the second pressing portion 161 is a lower half of an inner circumferential surface of a hole that rotatably supports the pressing roller shaft 131. The second pressing portion 161 may not have the shape described in the present embodiment, and may have any shape that allows its contact with the pressing roller 130 for pressing the pressing roller 130 against the fixing roller 120. For example, the second pressing portion 161 may be a protrusion.

The fifth beam portion 160B vertically extends from the front end of the fourth beam portion 160A toward the first arm 150. The fifth beam portion 160B is at the same position as the second beam portion 150B in the front-rear direction.

The sixth beam portion 160C extends in the front-rear direction from the upper end of the fifth beam portion 160B away from the second shaft A2. The sixth beam portion 160C includes a second pressed portion 164, which is pressed by a second cam 182 described later. The sixth beam portion 160C has its end away from the fifth beam portion 160B to serve as a second connector 162, to which a second end of the corresponding tension spring 170 is connected.

The second connector 162 is located opposite to the second shaft A2 with the second pressing portion 161 between them. The second connector 162 may have any shape that allows its contact with the tension spring 170 for pressing the pressing roller 130 against the fixing roller 120. The second connector 162 may be, for example, a hole or a protrusion.

The tension spring 170 urges the first pressing portion 151 and the second pressing portion 161 toward each other. The tension spring 170 is connected to the first connector 152 of the corresponding first arm 150 and the second connector 162 of the corresponding second arm 160.

The separating cam assembly 180 presses the first arm 150 or the second arm 160 against the urging force of the tension spring 170. The separating cam assembly 180 is located between the first arm 150 and the second arm 160, and is supported by the front wall 141 of the side frame 140 with a third shaft A3 parallel to the first shaft A1. The separating cam assembly 180 is rotatable about the third shaft A3. The separating cam assembly 180 is located nearer to the first connector 152 than to the first shaft A1, and nearer to the second connector 162 than to the second shaft A2. In other words, the separating cam assembly 180 is located opposite to the first shaft A1 with the first pressing portion 151 between them, and opposite to the second shaft A2 with the second pressing portion 161 between them.

Figure 4A:
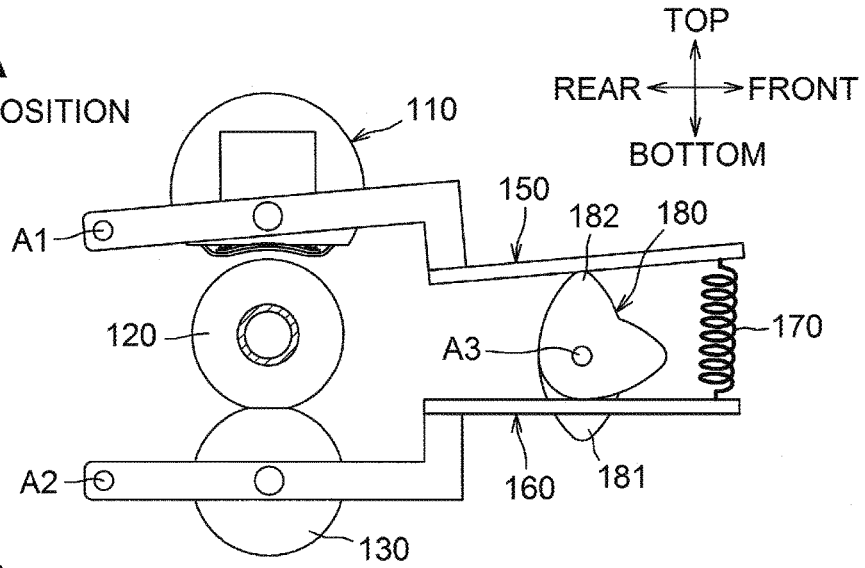
FIGS. 4A to 4C are side views of the fixing device showing its components viewed from the left, including the first arm and the second arm, and the separating cam at a second position in FIG. 4A, at a third position in FIG. 4B, and at a fourth position in FIG. 4C.
Figure 4B:
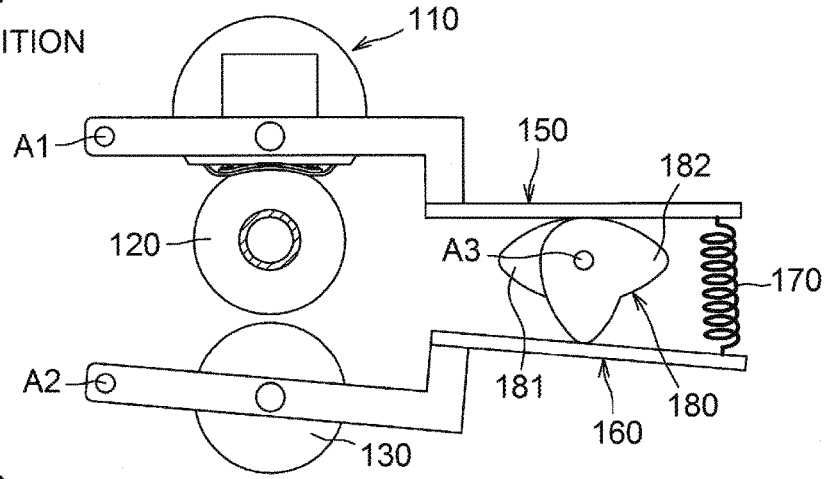
Figure 4C:
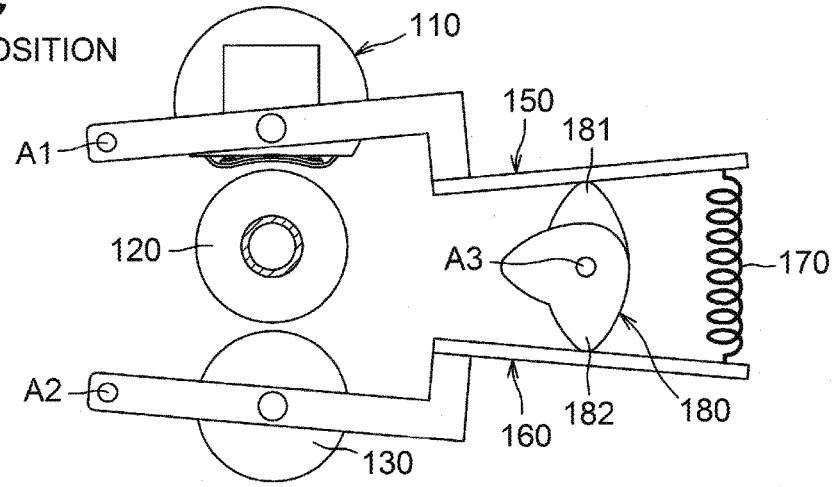

The separating cam assembly 180 is movable between a first position shown in FIG. 3, a second position shown in FIG. 4A, a third position shown in FIG. 4B, and a fourth position shown in FIG. 4C when driven by a single drive 400. The separating cam assembly 180 moves between the first to fourth positions to switch the heating unit 110, the fixing roller 120, and the pressing roller 130 between four nip modes. More specifically, the drive 400 rotates the separating cam assembly 180 by every 90 degrees in one direction. The separating cam assembly 180 moves to the second position when rotated by 90 degrees from the first position, to the third position when rotated by 90 degrees from the second position, to the fourth position when rotated by 90 degrees from the third position, and to the first position when rotated by 90 degrees from the fourth position, and then moves likewise. The four modes will be described first, and then the components including the separating cam assembly 180 will be described in detail. The four nip modes herein are a full-nip mode shown in FIG. 3, a heat-nip release mode shown in FIG. 4A, a press-nip release mode shown in FIG. 4B, and a full-nip release mode shown in FIG. 4C.

When the separating cam assembly 180 is at the first position shown in FIG. 3, the heating unit 110 and the pressing roller 130 are both pressed against the fixing roller 120. This is the full-nip mode. At this first position, the heat nip HN has a first width, and the press nip PN has a second width. The width of the heat nip HN and the width of the press nip PN are their dimensions in the front-rear direction. The heat nip HN corresponds to a first nip between the first pressing body and the fixing member. The press nip PN corresponds to a second nip between the second pressing body and the fixing member.

When the separating cam assembly 180 is at the second position shown in FIG. 4A, the heating unit 110 is apart from the fixing roller 120, and only the pressing roller 130 is pressed against the fixing roller 120. This is the heat-nip release mode. At this second position, the heat nip HN has a third width smaller than the first width, and the press nip PN has the second width. The heating unit 110 apart from the fixing roller 120 forms no heat nip HN, which thus has the third width being zero.

When the separating cam assembly 180 is at the third position shown in FIG. 4B, the pressing roller 130 is apart from the fixing roller 120, and only the heating unit 110 is pressed against the fixing roller 120. This is the press-nip release mode. At this third position, the heat nip HN has the first width, and the press nip PN has a fourth width smaller than the second width. The pressing roller 130 apart from the fixing roller 120 forms no press nip PN, which thus has the fourth width being zero.

When the separating cam assembly 180 is at the fourth position shown in FIG. 4C, the heating unit 110 and the pressing roller 130 are both apart from the fixing roller 120. This is the full nip-release mode. At this fourth position, the heat nip HN has a fifth width smaller than the first width, and the press nip PN has a sixth width smaller than the second width. The heating unit 110 and the pressing roller 130 apart from the fixing roller 120 form no heat nip HN and no press nip PN, which thus have the fifth width and the sixth width both being zero.

Figure 5:
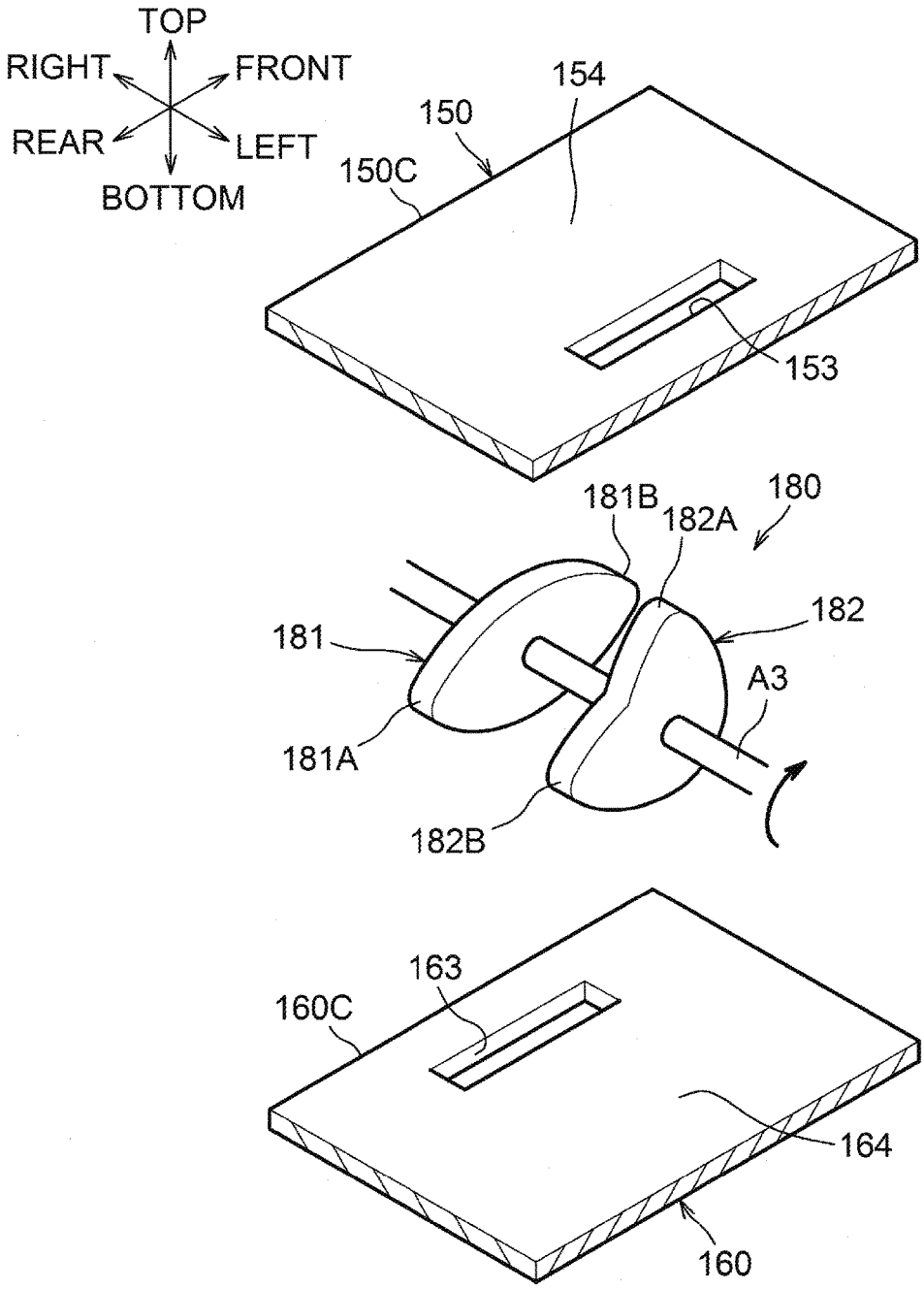
FIG. 5 is a perspective view of the separating cam and the arms showing their relationship.

As shown in FIG. 5, the separating cam assembly 180 includes a first cam 181, which presses the first arm 150 against the urging force of the tension spring 170, and a second cam 182, which rotates in coordination with the first cam 181 to press the second arm 160 against the urging force of the tension spring 170.

The first cam 181 is substantially elliptical, and includes a first cam surface 181A, which comes into contact with the first arm 150 when the separating cam assembly 180 is at the second position, and a second cam surface 181B, which comes into contact with the first arm 150 when the separating cam assembly 180 is at the fourth position.

The first cam surface 181A is at a position away from the second cam surface 181B by 180 degrees in the rotation direction of the separating cam assembly 180. When the separating cam assembly 180 is at the first position, the first cam surface 181A faces rearward, and the second cam surface 181B faces frontward.

The first cam 181 and the second cam 182 are fixed on the third shaft A3 at different positions in the axial direction of the third shaft A3. The first cam 181 and the second cam 182 are thus integrally rotatable about the third shaft A3. The second cam 182 has a third cam surface 182A, which comes into contact with the second arm 160 when the separating cam assembly 180 is at the third position, and a fourth cam surface 182B, which comes into contact with the second arm 160 when the separating cam assembly 180 is at the fourth position. The third cam surface 182A is downstream from the fourth cam surface 182B by 90 degrees in the rotation direction of the separating cam assembly 180. When the separating cam assembly 180 is at the first position, the third cam surface 182A faces upward, and the fourth cam surface 182B faces rearward. The fourth cam surface 182B is at the same position as the first cam surface 181A in the rotation direction of the separating cam assembly 180.

The third beam portion 150C has a width in the axial direction of the third shaft A3 greater than the distance between the first cam 181 and the second cam 182. The third beam portion 150C has a first opening 153, which receives the second cam 182, at the same position as the second cam 182 in the axial direction of the third shaft A3. In detail, the first opening 153 receives a protrusion of the second cam 182 having the third cam surface 182A, and a protrusion of the second cam 182 having the fourth cam surface 182B. The first opening 153 prevents the second cam 182 from pressing the first arm 150. A portion of the first arm 150 corresponding to the first cam 181 serves as a first pressed portion 154, which is pressed by the first cam 181.

The sixth beam portion 160C has a width in the axial direction of the third shaft A3 greater than the distance between the first cam 181 and the second cam 182. The sixth beam portion 160C has a second opening 163, which receives the first cam 181, at the same position as the first cam 181 in the axial direction of the third shaft A3. In detail, the second opening 163 receives a protrusion of the first cam 181 having the first cam surface 181A, and a protrusion of the first cam 181 having the second cam surface 181B. The second opening 163 prevents the first cam 181 from pressing the second arm 160. A portion of the second arm 160 corresponding to the second cam 182 serves as a second pressed portion 164, which is pressed by the second cam 182.

As shown in FIG. 3, the first pressed portion 154 is located nearer the rotation center of the separating cam assembly 180 than the first pressing portion 151 in the vertical direction, or the direction in which the heating unit 110, the fixing roller 120, and the pressing roller 130 are arranged. The second pressed portion 164 is located nearer the rotation center of the separating cam assembly 180 than the second pressing portion 161 in the vertical direction.

The operation of the separating cam assembly 180 will now be described in detail.

Figures 6A, 6B, 6C, 6D:
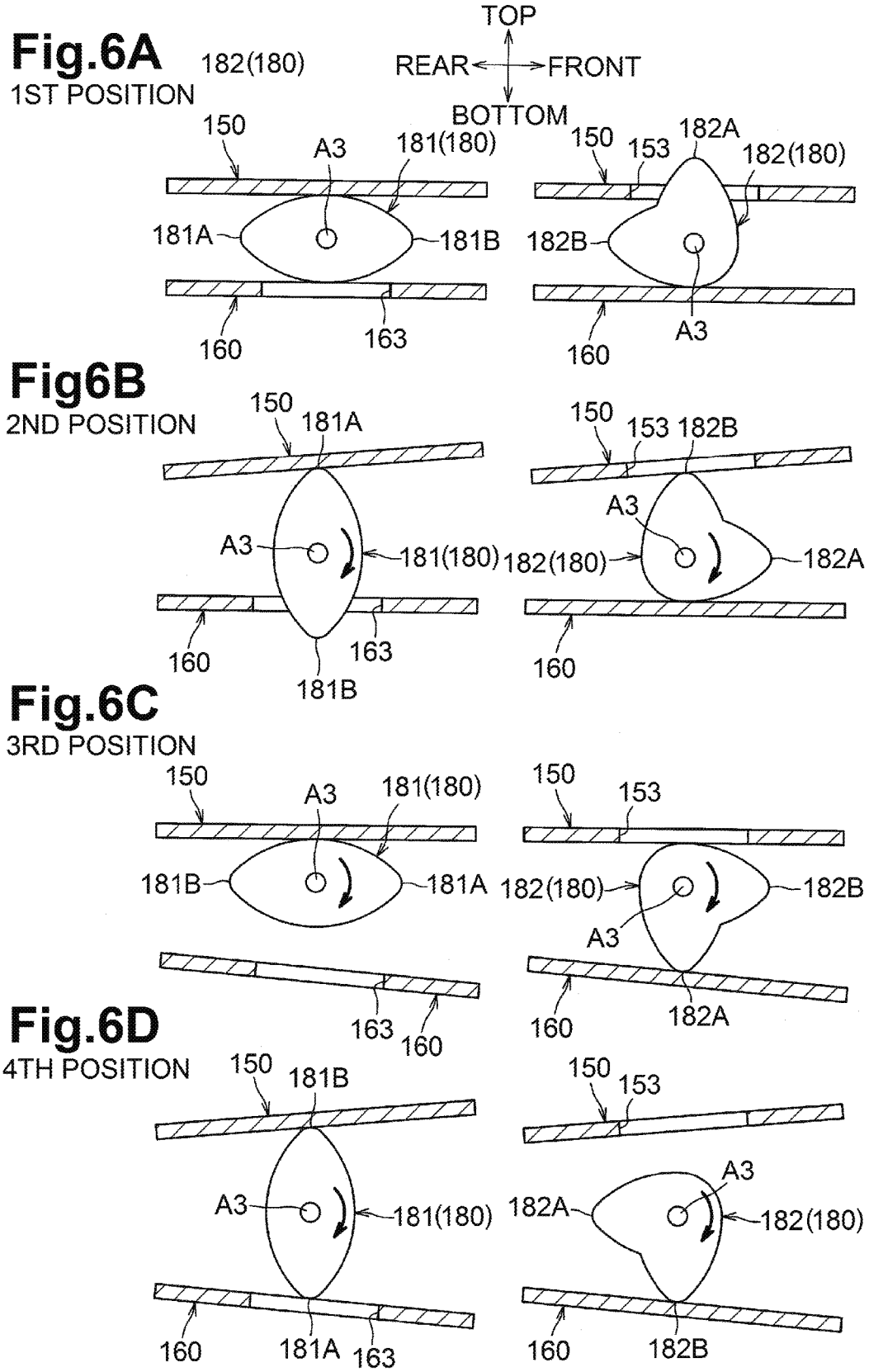
FIGS. 6A to 6D are cross-sectional views of the arms and the separating cam viewed from the left, showing the relationship between the arms and the separating cam at the first position in FIG. 6A, at the second position in FIG. 6B, at the third position in FIG. 6C, and at the fourth position in FIG. 6D.

As shown in FIG. 6A, when the separating cam assembly 180 is at the first position, the first cam 181 have its cam surfaces 181A and 181B located between and apart from the arms 150 and 160. The protrusion of the second cam 182 having the third cam surface 182A protrudes upward from the first arm 150 through the first opening 153 in the first arm 150. At this first position, the third cam surface 182A is located above the first arm 150 and apart from the arms 150 and 160, and the fourth cam surface 182B is located between and apart from the arms 150 and 160.

The arms 150 and 160 are supported by portions of the cams 181 and 182 with small diameters, and have their connection portions 152 and 162 located nearest each other. This enables the full-nip mode when the separating cam assembly 180 is at the first position shown in FIG. 3.

Referring now to FIG. 6A and then FIG. 6B, the separating cam assembly 180 rotates from the first position to the second position clockwise in the figures, and the first cam 181 presses the first arm 150 upward. The protrusion of the first cam 181 having the second cam surface 181B enters the second opening 163 of the second arm 160. Without pressed by the first cam 181, the second arm 160 thus remains at the same position.

As shown in FIG. 4A, only the first arm 150 rotates about the first shaft A1 counterclockwise in the figure, and only the heating unit 110 moves away from the fixing roller 120. This enables the heat-nip release mode when the separating cam assembly 180 is at the second position. In the heat-nip release mode or at the second position, the first cam surface 181A is in contact with the first arm 150, and the second cam surface 181B, the third cam surface 182A, and the fourth cam surface 182B are apart from the arms 150 and 160.

Referring now to FIG. 6B and then FIG. 6C, the separating cam assembly 180 rotates from the second position to the third position clockwise in the figures, and the protrusion of the first cam 181 having the first cam surface 181A retracts from the first arm 150, and the first arm 150 under the urging force of the tension spring 170 returns to the same position as when the separating cam assembly 180 is at the first position. When the separating cam assembly 180 rotates from the second position to the third position, the second cam 182 presses the second arm 160 downward for rotating the second arm 160.

When the arms 150 and 160 pivot as described above, the heating unit 110 apart from the fixing roller 120 is pressed against the fixing roller 120 again, and the pressing roller 130 is apart from the fixing roller 120 as shown in FIG. 4B. This enables the press-nip release mode when the separating cam assembly 180 is at the third position. In the press-nip release mode or at the third position, the first cam surface 181A, the second cam surface 181B, and the fourth cam surface 182B are apart from the arms 150 and 160, while the third cam surface 182A is in contact with the second arm 160.

Referring now to FIG. 6C and then FIG. 6D, the separating cam assembly 180 rotates clockwise in the figures from the third position to the fourth position, and the protrusion of the first cam 181 having the second cam surface 181B presses the first arm 150 upward, and the protrusion of the second cam 182 having the fourth cam surface 182B presses the second arm 160 downward.

In the present embodiment, the second cam 182 includes a portion recessed toward the third shaft A3 between the protrusion having the third cam surface 182A and the protrusion having the fourth cam surface 182B. When the separating cam assembly 180 rotates from the third position to the fourth position, the second arm 160 pivots upward and then pivots downward after pressed again by the protrusion having the fourth cam surface 182B. At the fourth position, to retain the second arm 160 at the same position as when the separating cam assembly 180 at the third position, the third cam surface 182A and the fourth cam surface 182B may be connected with arc surfaces having the third shaft A3 at the center.

As described above, the cams 181 and 182 pivot the arms 150 and 160 away from each other. As shown in FIG. 4C, the heating unit 110 and the pressing roller 130 are both apart from the fixing roller 120. This enables the full nip-release mode when the separating cam assembly 180 is at the fourth position. In the full-nip release mode or at the fourth position, the second cam surface 181B is in contact with the first arm 150, the fourth cam surface 182B is in contact with the second arm 160, and the first cam surface 181A and the third cam surface 182A are apart from the arms 150 and 160.

Referring now to FIG. 6D and then FIG. 6A, the separating cam assembly 180 rotates clockwise in the figures from the fourth position to the first position, and the second cam surface 181B of the first cam 181 retracts from the first arm 150, and the first arm 150 returns to the same position as when the separating cam assembly 180 is at the first position. The protrusion of the second cam 182 having the third cam surface 182A moves toward the first arm 150, and enters the first opening 153 in the first arm 150 without pressing the first arm 150 upward. The second arm 160 returns to the same position as when the separating cam assembly 180 is at the first position, after the first cam surface 181A of the first cam 181 and the fourth cam surface 182B of the second cam 182 move away from the second arm 160.

The present embodiment has the advantageous effects described below.

The separating cam assembly 180 is movable between the four positions with the single drive 400 to switch between the four nip modes. The simple structure thus allows switching between the four nip modes.

The separating cam assembly 180 is located opposite to the first shaft A1 with the first pressing portion 151 between them, and opposite to the second shaft A2 with the second pressing portion 161 between them. This structure uses a smaller driving torque for the separating cam assembly 180 than the structure including, for example, a separating cam between the pressing portions and the shafts.

The first cam 181 and the second cam 182 are coaxial. This prevents the fixing device 100 from upsizing, unlike, for example, the structure including the rotation shafts of the first cam and the second cam arranged parallel to each other.

The pressed portions 154 and 164 are located nearer the rotation center of the separating cam assembly 180 than the pressing portions 151 and 161. This prevents the separating cam assembly 180 from upsizing.

Second Embodiment

A second embodiment of the disclosure will now be described in detail with reference to the drawings. A fixing device according to the present embodiment has the structure modified from the fixing device 100 according to the first embodiment. The components substantially the same as those in the first embodiment are given the same reference numerals as those components, and will not be described.

Figure 7:
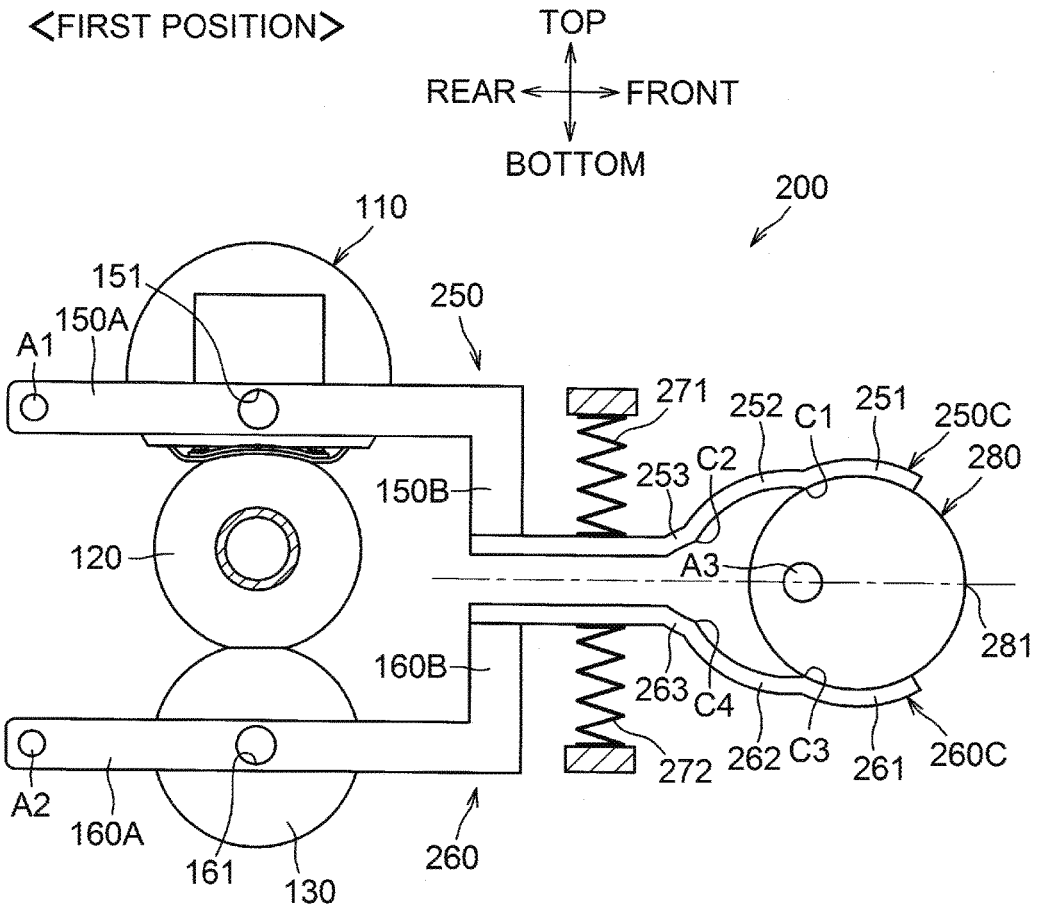
FIG. 7 is a side view of a fixing device according to a second embodiment viewed from the left, including a separating cam at a first position.

As shown in FIG. 7, a fixing device 200 according to the second embodiment includes, on each side, a first compression spring 271 and a second compression spring 272, each of which is an example of an elastic member, and a first arm 250, a second arm 260, and a separating cam 280, which each have the structure different from the corresponding structure described in the first embodiment.

The separating cam 280 rotates by every 90 degrees counterclockwise in the figure when driven by the drive 400 described above, and is thus movable between the four positions. Unlike in the first embodiment, the separating cam 280 is movable from a first position shown in FIG. 7, a second position shown in FIG. 8A, a fourth position shown in FIG. 8B, and a third position shown in FIG. 8C in this order.

The separating cam 280 is a disc-shaped eccentric cam with the third shaft A3, which serves as the rotation center, displaced from the center of the disc. The separating cam 280 has an apex 281 on its outer circumferential surface, which is most distant from the third shaft A3 and faces forward at the first position.

The first compression spring 271 is located on the first arm 250 and urges the first arm 250 downward. The second compression spring 272 is located under a portion of the second arm 260 and urges the second arm 260 upward.

The first arm 250 includes a first beam portion 150A and a second beam portion 150B, which are substantially the same as the corresponding components in the first embodiment, and a third beam portion 250C, which is different from the corresponding component in the first embodiment. The third beam portion 250C includes a first holding portion 251, a second holding portion 252, and a third holding portion 253, which each have an arc-shaped cross-section. The first holding portion 251 is in contact with the outer circumferential surface of the separating cam 280 at the first position. The second holding portion 252 is in contact with the outer circumferential surface of the separating cam 280 at the second position. The third holding portion 253 is in contact with the outer circumferential surface of the separating cam 280 at the fourth position. The third beam portion 250C includes a first point C1 and a second point C2, which each are an example of a first pressed portion.

The second holding portion 252 is located between the first holding portion 251 and the second beam portion 150B. The third holding portion 253 is located between the second holding portion 252 and the second beam portion 150B. The second holding portion 252 and the third holding portion 253 are oriented to have the first arm 250 at the same position as when the second holding portion 252 is supported by the separating cam 280 at the second position and when the third holding portion 253 is supported by the separating cam 280 at the fourth position. The first compression spring 271 is in contact with a portion of the first arm 250 between the second beam portion 150B and the third holding portion 253.

The first point C1 is located between the first holding portion 251 and the second holding portion 252. The second point C2 is located between the second holding portion 252 and the third holding portion 253. When the separating cam 280 is at the first position, the points C1 and C2 are located nearer the rotation center of the separating cam 280 than the first pressing portion 151 in the vertical direction, and the first point C1 is at a higher position than the second point C2.

The second arm 260 includes a fourth beam portion 160A and a fifth beam portion 160B, which are substantially the same as the corresponding components in the first embodiment, and a sixth beam portion 260C, which is different from the corresponding component in the first embodiment. The sixth beam portion 260C includes a fourth holding portion 261, a fifth holding portion 262, and a sixth holding portion 263, which each have an arc-shaped cross-section. The fourth holding portion 261 is in contact with the outer circumferential surface of the separating cam 280 at the first position. The fifth holding portion 262 is in contact with the outer circumferential surface of the separating cam 280 at the third position. The sixth holding portion 263 is in contact with the outer circumferential surface of the separating cam 280 at the fourth position. The second arm 260 includes a third point C3 and a fourth point C4, which each are an example of a second pressed portion.

The fifth holding portion 262 is located between the fourth holding portion 261 and the fifth beam portion 160B. The sixth holding portion 263 is located between the fifth holding portion 262 and the fifth beam portion 160B. The fifth holding portion 262 and the sixth holding portion 263 are oriented to have the second arm 260 at the same position as when the fifth holding portion 262 is supported by the separating cam 280 at the third position and when the sixth holding portion 263 is supported by the separating cam 280 at the fourth position. The second compression spring 272 is in contact with a portion of the second arm 260 between the fifth beam portion 160B and the sixth holding portion 263.

The third point C3 is located between the fourth holding portion 261 and the fifth holding portion 262. The fourth point C4 is located between the fifth holding portion 262 and the sixth holding portion 263. When the separating cam 280 is at the first position, the points C3 and C4 are located nearer the rotation center of the separating cam 280 than the second pressing portion 161 in the vertical direction, and the third point C3 is at a lower position than the fourth point C4.

In the second embodiment, when the separating cam 280 is at the first position in FIG. 7, the separating cam 280 supports the first holding portion 251 and the fourth holding portion 261 that are located nearest each other. This enables the full-nip mode. In the present embodiment, the arms 250 and 260 are supported by another restricting member (not shown) in addition to the separating cam 280 to have the first holding portion 251 and the fourth holding portion 261 located nearest each other when the separating cam 280 is at the first position.

Figure 8A:
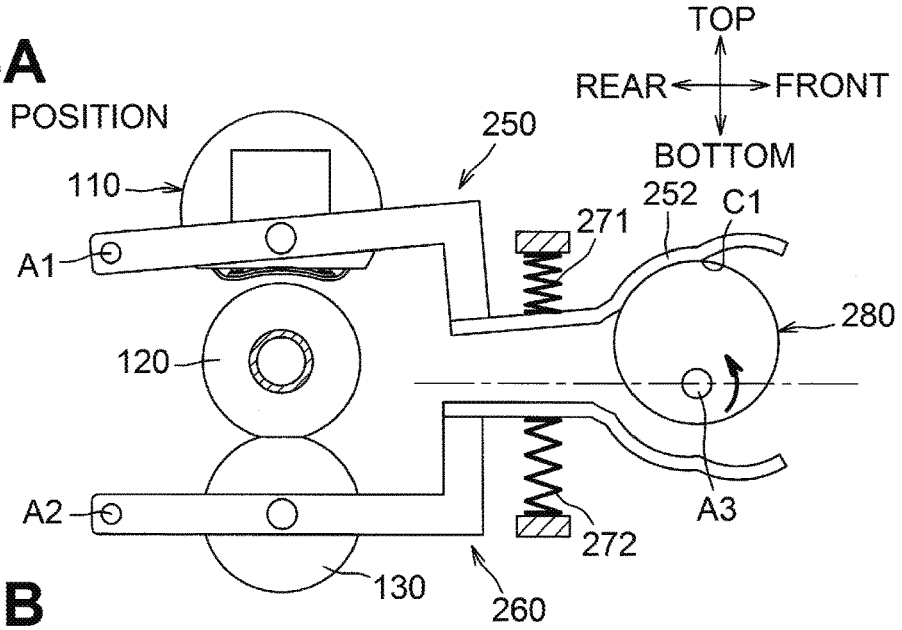
FIGS. 8A to 8C are side views of the fixing device according to the second embodiment viewed from the left, including the separating cam at a second position in FIG. 8A, at a fourth position in FIG. 8B, and at a third position in FIG. 8C.

Referring now to FIG. 7 and then FIG. 8A, when rotating from the first position toward the second position, the separating cam 280 presses the first point C1 upward, and the first arm 250 pivots upward. When the separating cam 280 rotates to the second position, the second holding portion 252 is supported by the separating cam 280. This enables the heat-nip release mode.

Figure 8B:
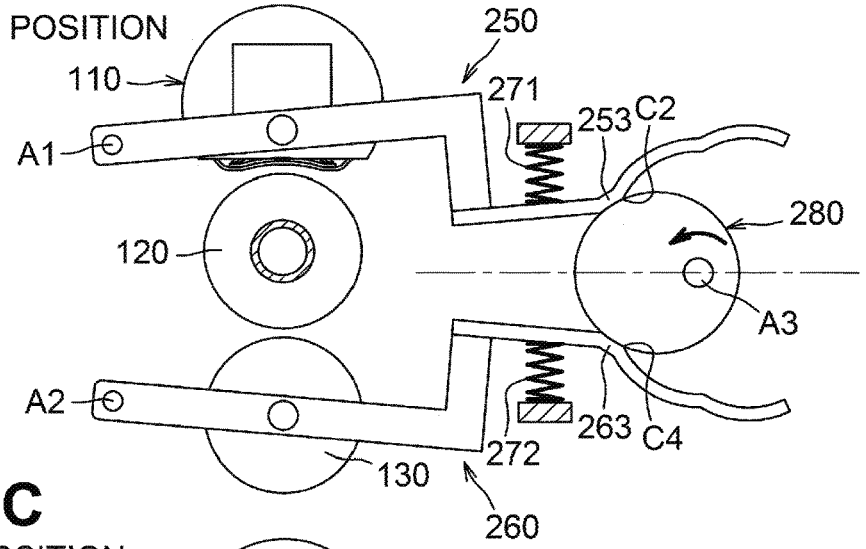

Referring now to FIG. 8A and then FIG. 8B, when rotating from the second position toward the fourth position, the separating cam 280 presses the second point C2 upward, and presses the fourth point C4 downward. The arms 250 and 260 rotate away from each other. When the separating cam 280 rotates to the fourth position, the third holding portion 253 and the sixth holding portion 263 are supported by the separating cam 280. This enables the full nip-release mode.

Figure 8C:
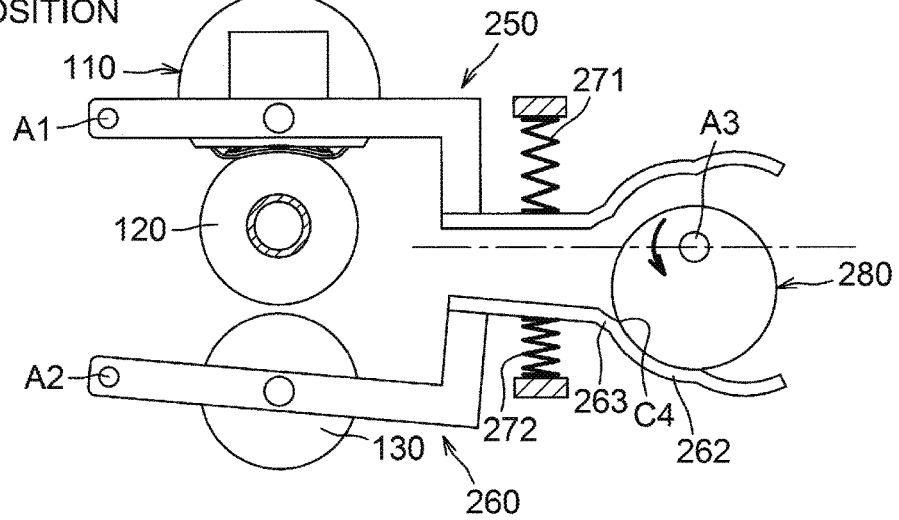

Referring now to FIG. 8B and then FIG. 8C, when rotating from the fourth position toward the third position, the separating cam 280 retracts from the first arm 250, and the first arm 250 pivots downward to return to the same position as when the separating cam 280 is at the first position. When the separating cam 280 presses the fourth point C4 downward temporarily and fits into the recessed fifth holding portion 262, the second arm 260 is temporarily lowered from the position when the separating cam 280 is at the fourth position, and then returns to the same position as when the separating cam 280 is at the fourth position. This enables the press-nip release mode.

Referring now to FIG. 8C and then FIG. 7, when rotating from the third position toward the first position, the separating cam 280 retracts from the second arm 260, and the second arm 260 pivots upward and returns to the same position as when the separating cam 280 is at the first position.

Third Embodiment

A third embodiment of the disclosure will now be described in detail with reference to the drawings. A fixing device according to the present embodiment has the structure modified from the fixing device 100 according to the first embodiment. The components substantially the same as those in the first embodiment are given the same reference numerals as those components, and will not be described.

Figure 9:
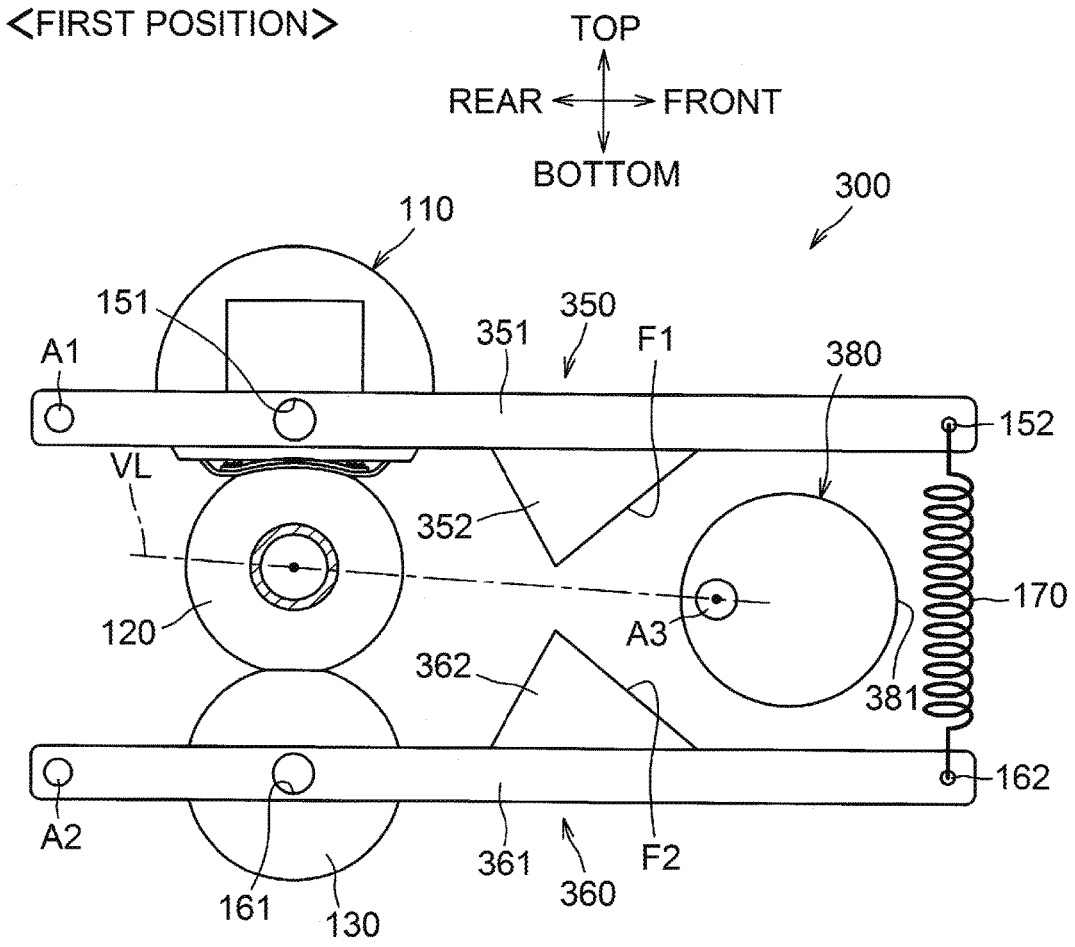
FIG. 9 is a side view of a fixing device according to a third embodiment viewed from the left, including a separating cam at a first position.

As shown in FIG. 9, a fixing device 300 according to the third embodiment includes, on each side, a first arm 350 a second arm 360, and a separating cam 380, which each have the structure different from the corresponding structure described in the first embodiment. The separating cam 380 is an eccentric cam having substantially the same structure as the separating cam 280 according to the second embodiment.

The separating cam 380 rotates by every 90 degrees counterclockwise in the figure when driven by the drive 400 described above, and is thus movable between the four positions. As in the second embodiment, the separating cam 380 is movable from a first position shown in FIG. 9, a second position shown in FIG. 10A, a fourth position shown in FIG. 10B, and a third position shown in FIG. 10C in this order. The separating cam 380 has an apex 381 facing forward at the first position.

The first arm 350 includes a first arm body 351 extending in the front-rear direction when the separating cam 380 is at the first position, and a first protrusion 352 protruding from the first arm body 351 toward the second arm 360. The first arm body 351 has its rear end portion pivotably supported by the first shaft A1. The first arm body 351 includes a first pressing portion 151 and a first connector 152, which are substantially the same as the corresponding components in the first embodiment.

The first protrusion 352 is located between the first pressing portion 151 and the first connector 152. In detail, the first protrusion 352 is located between the first pressing portion 151 and the rotation center of the separating cam 380 in the front-rear direction. The first protrusion 352 is wedge-shaped, and tapers toward the second arm 360.

The first protrusion 352 has a first slope F1. The first slope F1 includes a first pressed portion, which is pressed by the separating cam 380. The first slope F1 is inclined with respect to a virtual line VL connecting the rotation center of the fixing roller 120 and the rotation center of the separating cam 380. The first slope F1 has its rear end located between the first pressing portion 151 and the rotation center of the separating cam 380.

The second arm 360 includes a second arm body 361 extending in the front-rear direction when the separating cam 380 is at the first position, and a second protrusion 362 protruding from the second arm body 361 toward the first protrusion 352. The second arm body 361 has its rear end portion pivotably supported by the second shaft A2. The second arm body 361 includes a second pressing portion 161 and a second connector 162, which are substantially the same as the corresponding components in the first embodiment.

The second protrusion 362 is located between the second pressing portion 161 and the second connector 162. In detail, the second protrusion 362 is located between the second pressing portion 161 and the rotation center of the separating cam 380 in the front-rear direction. The second protrusion 362 is wedge-shaped, and tapers toward the first protrusion 352.

The second protrusion 362 has a second slope F2. The second slope F2 includes a second pressed portion, which is pressed by the separating cam 380. The second slope F2 is inclined with respect to the virtual line VL. The second slope F2 has its rear end vertically facing the rear end of the first slope F1 when the separating cam 380 is at the first position. The slopes F1 and F2 are inclined and are more away from each other toward the rotation center of the separating cam 380 in the direction along the virtual line VL.

The first slope F1 is at the angle and the position to allow the first arm 350 to remain at the same position whether the separating cam 380 is at the second position or at the fourth position. The second slope F2 is at the angle and the position to allow the second arm 360 to remain at the same position whether the separating cam 380 is at the third position or at the fourth position.

In the third embodiment, the separating cam 380 at the first position shown in FIG. 9 is apart from the arms 350 and 360. When the separating cam 380 is at the first position, the arms 350 and 360 have their movements toward each other restricted by the fixing roller 120 or another restricting member (not shown). The pressing portions 151 are 161 are located nearest each other. This enables the full-nip mode.

Figure 10A:
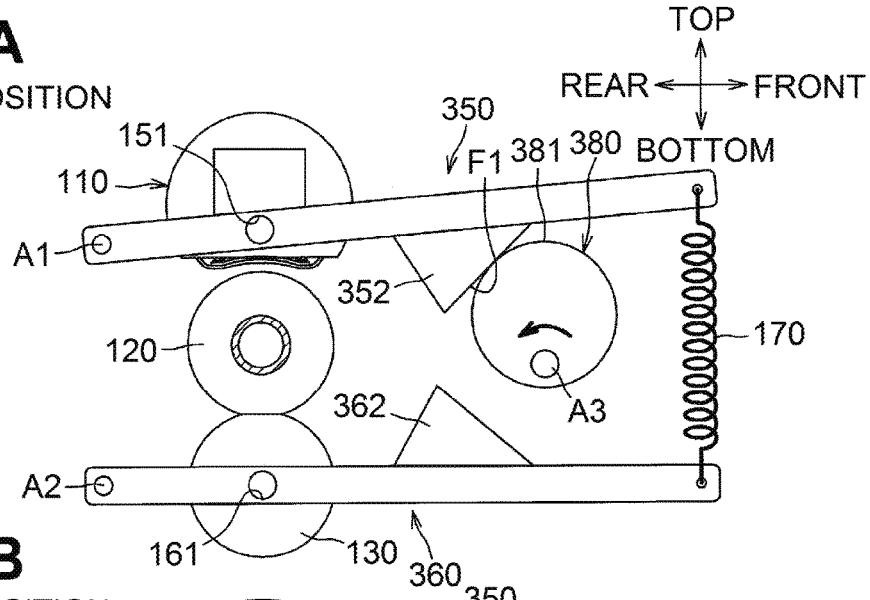
FIGS. 10A to 10C are side views of the fixing device according to the third embodiment viewed from the left, including the separating cam at a second position in FIG. 10A, at a fourth position in FIG. 10B, and at a third position in FIG. 10C.

Referring now to FIG. 9 and then FIG. 10A, when rotating from the first position toward the second position, the separating cam 380 presses the first arm body 351 and the first protrusion 352 upward, and the first arm 350 pivots upward. After rotating to the second position, the separating cam 380 supports substantially the center portion of the first slope F1. This enables the heat-nip release mode. In the heat-nip release mode or at the second position, the separating cam 380 is in contact with the first slope F1 and apart from the second arm 360.

Figure 10B:
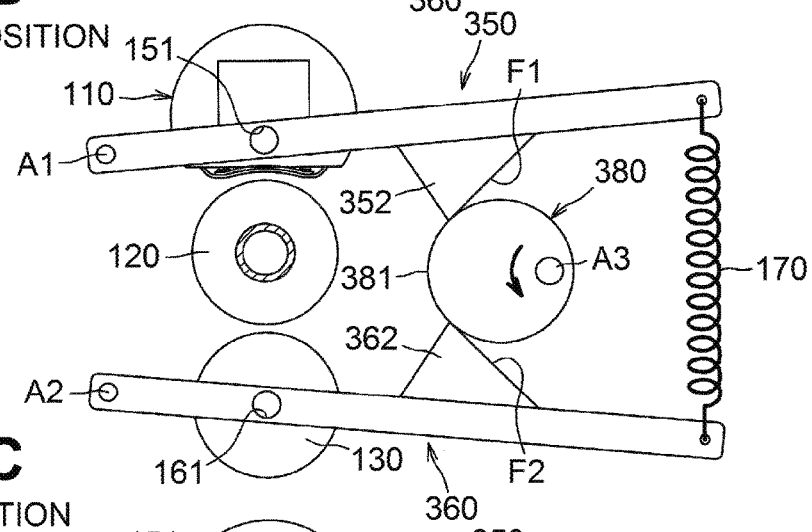

Referring now to FIG. 10A and then FIG. 10B, when rotating from the second position toward the fourth position and having its apex 381 approaching the first slope F1, the separating cam 380 presses the first slope F1 upward. Subsequently, when having its apex 381 moving away from the first slope F1, the separating cam 380 supports the first arm 350 that gradually moves downward.

When coming into contact with the second slope F2 of the second protrusion 362, the separating cam 380 presses the second protrusion 362 downward, and thus the second arm 360 pivots downward. After rotating to the fourth position, the separating cam 380 supports the slopes F1 and F2, and the arms 350 and 360 have their ends open more than when the separating cam 380 is at the first position. This enables the full nip-release mode. In the full nip-release mode or at the fourth position, the separating cam 380 is in contact with the slopes F1 and F2.

Figure 10C:
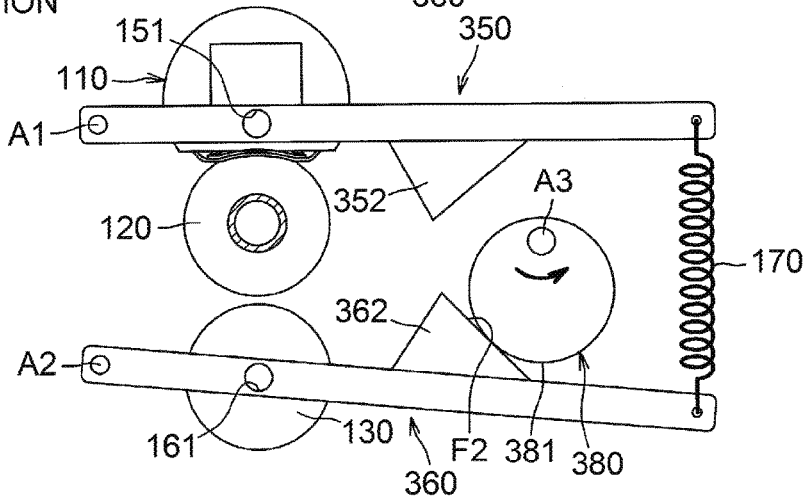

Referring now to FIG. 10B and then FIG. 10C, when rotating from the fourth position toward the third position, the separating cam 380 retracts from the first arm 350, and the first arm 350 pivots downward and returns to the same position as when the separating cam 380 is at the first position. When the apex 381 of the separating cam 380 moves toward and then away from the second slope F2, the second arm 360 moves downward temporarily and then pivots upward again to return to the same position as when the separating cam 380 is at the fourth position. This enables the press-nip release mode. In the press-nip release mode or at the third position, the separating cam 380 is in contact with the second slope F2 and apart from the first arm 350.

Referring now to FIG. 10C and then FIG. 9, when rotating from the third position toward the first position, the separating cam 380 retracts from the second arm 360, and the second arm 360 pivots upward and returns to the same position as when the separating cam 380 is at the first position.

The invention is not limited to the embodiments described above, and may be modified in various forms as described below.

In the above embodiments, the heat nip HN and the press nip PN have the third, fourth, fifth, and sixth widths all being zero. In some embodiments, the third and fifth widths may be any width smaller than the first width. The fourth and sixth widths may be any width smaller than the second width. More specifically, the heating unit and the fixing roller may be in contact with each other in the heat-nip release mode, and the fixing roller and the pressing roller may be in contact with each other in the press-nip release mode. The third width may be either equal to, smaller than, or greater than the fifth width. The fourth width may be either equal to, smaller than, or greater than the sixth width.

In the above embodiments, when the separating cam is at the first position and the second position, the press nip PN has the same width or the second width. In some embodiments, when the separating cam is at the second position, the press nip PN may have a width greater than the second width. In the above embodiments, when the separating cam is at the first position and the third position, the heat nip HN has the same width or the first width. In some embodiments, when the separating cam is at the third position, the heat nip HN may have a width greater than or equal to the first width.

In the first embodiment, the first cam 181 and the second cam 182 are coaxial. In some embodiments, the first cam may be located under the first arm, and the second cam may be located between the first cam and the second arm in the vertical direction. In this structure, each arm may have no opening.

In the first embodiment, the openings 153 and 163 are holes. In some embodiments, the openings 153 and 163 may be replaced by recesses on the edges of the arms. In the first embodiment, the arms 150 and 160 may have a width in the axial direction of the third shaft A3 smaller than the distance between the first cam 181 and the second cam 182. In this structure, the first arm 150 may be at the same position as the first cam 181 in the axial direction, and the second arm 160 may be at the same position as the second cam 182 in the axial direction.

In the above embodiments, the drive 400 drives and rotates each cam in the single direction. In some embodiments, the drive may drive each cam both forward and rearward.

In the above embodiments, the heating unit 110, the pressing roller 130, and the fixing roller 120 are examples of a first pressing body, a second pressing body, and a fixing member. In some embodiments, for example, the first pressing body may be a first pressing roller, the second pressing body may be a second pressing roller, and the fixing member may be a heating roller with an internal heater.

In the first embodiment, the separating cam assembly 180 presses the portions of the arms 150 and 160 between the pressing portions 151 and 161 and the connection portions 152 and 162. In some embodiments, for example, the connection portions may be located apart from the ends of the arms, and the separating cam may press portions of the arms opposite to the pressing portions with the connection portions between them.

In the above embodiments, the tension spring 170 and the compression springs 271 and 272 are examples of elastic members. In some embodiments, the elastic members may be a torsion spring and a flat spring. For the first and second connection portions of the arms crossing each other and having the positional relationship vertically reversed from the structure described in the above embodiments, an elastic member may be a component such as a compression spring that presses the first and second connection portions away from each other.

In the above embodiments, the halogen lamp 112 is as an example of a heater. In some embodiments, the heater may be a carbon heater.

In the above embodiments, the endless belt 111 is as an example of a heating member. In some embodiments, the heating member may be a heating roller formed of a cylindrical metal member.

The parts of each arm including the rotation shaft, the pressing portion, and the connection portion may be located at any other positions or at any other distances between them, instead of the positions and the distances described in the above embodiments.

In the above embodiments, the sheets P, such as cardboard, postcards, or thin paper, are examples of a recording sheet. In some embodiments, the recording sheet may be a sheet for an overhead projector (OHP).

The holding portions 251 to 253 and 261 to 263 according to the second embodiment each may not have an arc-shaped cross-section, and may have any other cross-section, such as a flat or V-shaped cross-section.

In the above embodiments, the pressing roller 130 is an example of a pressing member. In some embodiments, the pressing member may be, for example, a pressing pad that is not rotatable.

The components described in the above embodiments and modifications may be combined as appropriate.

While the features herein have been described in connection with various example structures and illustrative aspects, it will be understood by those skilled in the art that other variations and modifications of the structures and aspects described above may be made without departing from the scope of the disclosure described herein. Other structures and aspects will be apparent to those skilled in the art from a consideration of the specification or practice of the features disclosed herein. It is intended that the specification and the described examples only are illustrative with the true scope of the disclosure being defined by the following claims.

What is claimed is:

1. A fixing device, comprising:

a first pressing body;

a second pressing body;

a fixing member located between the first pressing body and the second pressing body;

a heater configured to heat the fixing member;

a first arm pivotable about a first shaft, and including a first pressing portion configured to press the first pressing body against the fixing member;

a second arm pivotable about a second shaft parallel to the first shaft, and including a second pressing portion configured to press the second pressing body against the fixing member;

an elastic member configured to urge the first pressing portion and the second pressing portion toward each other; and a cam assembly located between the first arm and the second arm, and rotatable about a third shaft parallel to the first shaft, the cam assembly including:

a first cam configured to rotate about the third shaft and press the first arm against an urging force of the elastic member; and a second cam located at a position different from the first cam in an axial direction of the third shaft, the second cam being configured to rotate about the third shaft integrally with the first cam and press the second arm against the urging force of the elastic member, wherein:

the cam assembly is movable between a first position, a second position, a third position, and a fourth position when driven by a single drive, when the cam assembly is at the first position, a first nip between the first pressing body and the fixing member has a first width, and a second nip between the second pressing body and the fixing member has a second width, when the cam assembly is at the second position, the first nip has a third width smaller than the first width, and the second nip has a width greater than or equal to the second width, when the cam assembly is at the third position, the first nip has a width greater than or equal to the first width, and the second nip has a fourth width smaller than the second width, when the cam assembly is at the fourth position, the first nip has a fifth width smaller than the first width, and the second nip has a sixth width smaller than the second width, the first arm has a width in the axial direction of the third shaft that is greater than a distance between the first cam and the second cam, the second arm has a width in the axial direction of the third shaft that is greater than the distance between the first cam and the second cam, the first arm has a first opening at the same position as the second cam in the axial direction of the third shaft, the first opening being configured to receive the second cam, and the second arm has a second opening at the same position as the first cam in the axial direction of the third shaft, the second opening being configured to receive the first cam.

2. The fixing device according to claim 1, wherein the cam assembly is located opposite to the first shaft with the first pressing portion between the cam assembly and the first shaft, and opposite to the second shaft with the second pressing portion between the cam assembly and the second shaft.

3. The fixing device according to claim 1, wherein:

the first arm includes a first pressed portion configured to be pressed by the first cam, the second arm includes a second pressed portion configured to be pressed by the second cam, and in a direction in which the first pressing body, the fixing member, and the second pressing body are arranged, the first pressed portion is located closer to a rotation center of the cam assembly than the first pressing portion, and the second pressed portion is located closer to the rotation center of the cam assembly than the second pressing portion.

4. The fixing device according to claim 3, wherein:

the first arm includes:

a first beam portion including the first pressing portion and extending from the first shaft, a second beam portion extending from the first beam portion toward the second arm, and a third beam portion including the first pressed portion and extending from the second beam portion away from the first shaft, and the second arm includes:

a fourth beam portion including the second pressing portion and extending from the second shaft, a fifth beam portion extending from the fourth beam portion toward the first arm, and a sixth beam portion including the second pressed portion and extending from the fifth beam portion away from the second shaft.

5. The fixing device according to claim 1, wherein:

the first cam has a first cam surface and a second cam surface, each configured to press the first arm against the urging force of the elastic member, the second cam has a third cam surface and a fourth cam surface, each configured to press the second arm against the urging force of the elastic member, when the cam assembly is at the first position, the first cam surface and the second cam surface are positioned apart from the first arm, and the third cam surface and the fourth cam surface are positioned apart from the second arm, when the cam assembly is at the second position, the first cam surface is in contact with the first arm, and the third cam surface and the fourth cam surface are positioned apart from the second arm, when the cam assembly is at the third position, the first cam surface and the second cam surface are positioned apart from the first arm, and the third cam surface is in contact with the second arm, and when the cam assembly is at the fourth position, the second cam surface is in contact with the first arm, and the fourth cam surface is in contact with the second arm.

6. The fixing device according to claim 5, wherein:

the cam assembly is configured to rotate by 90 degrees between each of: the first position and the second position, the second position and the third position, and the third position and the fourth position, the first cam surface is at a position away from the second cam surface by 180 degrees in a rotation direction of the cam assembly, the third cam surface is at a position downstream from the fourth cam surface by 90 degrees in the rotation direction of the cam assembly, and the first cam surface and the fourth cam surface are at the same position in the rotation direction of the cam assembly.

7. The fixing device according to claim 1, wherein at least one of the third width, the fourth width, the fifth width, and the sixth width is zero.

8. The fixing device according to claim 1, wherein:

the first pressing body is a heating member including the heater, and the second pressing body is a pressing member configured to transport a recording substrate between the pressing member and the fixing member.

9. A fixing device, comprising:

a first pressing body;

a second pressing body;

a fixing member located between the first pressing body and the second pressing body;

a heater configured to heat the fixing member;

a first arm pivotable about a first shaft, and including a first pressing portion configured to press the first pressing body against the fixing member;

a second arm pivotable about a second shaft parallel to the first shaft, and including a second pressing portion configured to press the second pressing body against the fixing member;

urging means for urging the first pressing portion and the second pressing portion toward each other; and pressing means for pressing at least one of the first arm and the second arm against an urging force of the urging means, the pressing means being located between the first arm and the second arm, wherein:

the pressing means is movable between a first position, a second position, a third position, and a fourth position when driven by a single drive, when the pressing means is at the first position, a first nip between the first pressing body and the fixing member has a first width, and a second nip between the second pressing body and the fixing member has a second width, when the pressing means is at the second position, the first nip has a third width smaller than the first width, and the second nip has a width greater than or equal to the second width, when the pressing means is at the third position, the first nip has a width greater than or equal to the first width, and the second nip has a fourth width smaller than the second width, when the pressing means is at the fourth position, the first nip has a fifth width smaller than the first width, and the second nip has a sixth width smaller than the second width, the pressing means includes a first cam and a second cam, the first cam is configured to rotate about a third shaft parallel to the first shaft and press the first arm against an urging force of the urging means, the second cam is located at a position different from the first cam in an axial direction of the third shaft, the second cam being configured to rotate about the third shaft integrally with the first cam and press the second arm against the urging force of the urging means, the first arm has a width in the axial direction of the third shaft that is greater than a distance between the first cam and the second cam, the second arm has a width in the axial direction of the third shaft that is greater than the distance between the first cam and the second cam, the first arm has a first opening at the same position as the second cam in the axial direction of the third shaft, the first opening being configured to receive the second cam, and the second arm has a second opening at the same position as the first cam in the axial direction of the third shaft, the second opening being configured to receive the first cam.

10. The fixing device according to claim 9, wherein the pressing means is located opposite to the first shaft with the first pressing portion between the pressing means and the first shaft, and opposite to the second shaft with the second pressing portion between the pressing means and the second shaft.

11. The fixing device according to claim 9, wherein:

the pressing means is rotatable, the first arm includes a first pressed portion configured to be pressed by the pressing means, the second arm includes a second pressed portion configured to be pressed by the pressing means, and in a direction in which the first pressing body, the fixing member, and the second pressing body are arranged, the first pressed portion is located closer to a rotation center of the pressing means than the first pressing portion, and the second pressed portion is located closer to the rotation center of the pressing means than the second pressing portion.

12. The fixing device according to claim 11, wherein:

the first arm includes:

a first beam portion including the first pressing portion and extending from the first shaft, a second beam portion extending from the first beam portion toward the second arm, and a third beam portion including the first pressed portion and extending from the second beam portion away from the first shaft, and the second arm includes:

a fourth beam portion including the second pressing portion and extending from the second shaft, a fifth beam portion extending from the fourth beam portion toward the first arm, and a sixth beam portion including the second pressed portion and extending from the fifth beam portion away from the second shaft.

13. The fixing device according to claim 9, wherein at least one of the third width, the fourth width, the fifth width, and the sixth width is zero.

* * * * *